US006189472B1

(12) United States Patent
Duncan

(10) Patent No.: US 6,189,472 B1
(45) Date of Patent: Feb. 20, 2001

(54) CRAFT WITH TILTING SAIL

(76) Inventor: David Duncan, Higher Cholwell, Haberton, Totnes, Devon, TQ9 7RZ (GB)

( * ) Notice: Under 35 U.S.C. 154(b), the term of this patent shall be extended for 0 days.

(21) Appl. No.: 09/595,954

(22) Filed: Jun. 19, 2000

(30) Foreign Application Priority Data

Jun. 25, 1999 (GB) ..... 9914773

(51) Int. Cl.[7] ..... B63H 16/04
(52) U.S. Cl. ..... 114/102.16; 114/39.11
(58) Field of Search ..... 114/39.11, 39.21, 114/102.1, 102.6, 102.17, 102.18, 102.19, 102.2, 102.21, 105

(56) References Cited

U.S. PATENT DOCUMENTS 1,670,936 * 5/1928 McIntyre et al. ..... 114/102.18
3,090,340 * 5/1963 McCutchen et al. ..... 114/102.16
4,799,443 * 1/1989 Vogel ..... 114/39.32
4,864,949 * 9/1989 Olsen ..... 114/102.18

* cited by examiner

*Primary Examiner*—Jesus D. Sotelo
(74) *Attorney, Agent, or Firm*—Ira S. Dorman

(57) ABSTRACT

A single or multi-hulled sailing craft has a stub mast 5 upstanding from the hull. A sail 10 has a luff edge 11 secured to a luff boom 20 and a foot edge 12 secured to a foot boom 21 which is connected to the lower end of the luff boom. Part way along the luff boom 20 a pivotal fitting 22 connects the luff boom to the stub mast 5, and a rigid swing boom 26 is pivotally connected between the foot boom 21 and the hull or the stub mast. The fitting 22 can be moved up and down the stub mast 5 by means of a tilt sheet. The swing boom can be connected to a carriage which moves transversely of the hull. The sail is self-tacking and its position is positively controlled to prevent collision of the sail with the stub mast.

4 Claims, 6 Drawing Sheets

CRAFT WITH TILTING SAIL

TECHNICAL FIELD OF THE INVENTION

This invention relates to rigging for sailing craft. Normally the invention will be applied to watercraft although it could also be applied to land yachts and the like. The craft may be single or multi-hulled.

BACKGROUND

In conventional rigging the mainsail is secured along one vertical edge (the luff) to a mast which is mounted on the hull of the craft. A lower edge of the sail (the foot) is secured to a boom which is pivotally coupled to the lower end of the mast to swing to port and starboard. Movement of the boom is controlled by a mainsheet (rope) running between the boom and the deck.

U.S. Pat. No. 4,799,443 proposes a sailing boat in which the mainsail is mounted between a luff boom and a foot boom. The luff boom is attached to the top of the mast by a pivotal fitting that allows the luff boom to tilt from vertical. A pair of sheets (ropes) run between the foot boom and the hull to provide control over the tilting of the sail. The mast may be telescopic.

The present invention seeks to provide a new and inventive form of tilting sail arrangement.

SUMMARY OF THE INVENTION

The present invention proposes a sailing craft comprising:
at least one hull;
a stub mast upstanding from the hull or hulls;
a sail having a luff edge and a foot edge;
a luff boom to which the luff of the sail is secured;
a foot boom to which the foot of the sail is secured and which is connected to the lower end of the luff boom; and
a pivotal fitting connecting the luff boom to the stub mast;
characterised by a rigid swing boom which is pivotally connected between the foot boom and the hull or hulls or the stub mast.

The swing boom is preferably connected part-way along the foot boom.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
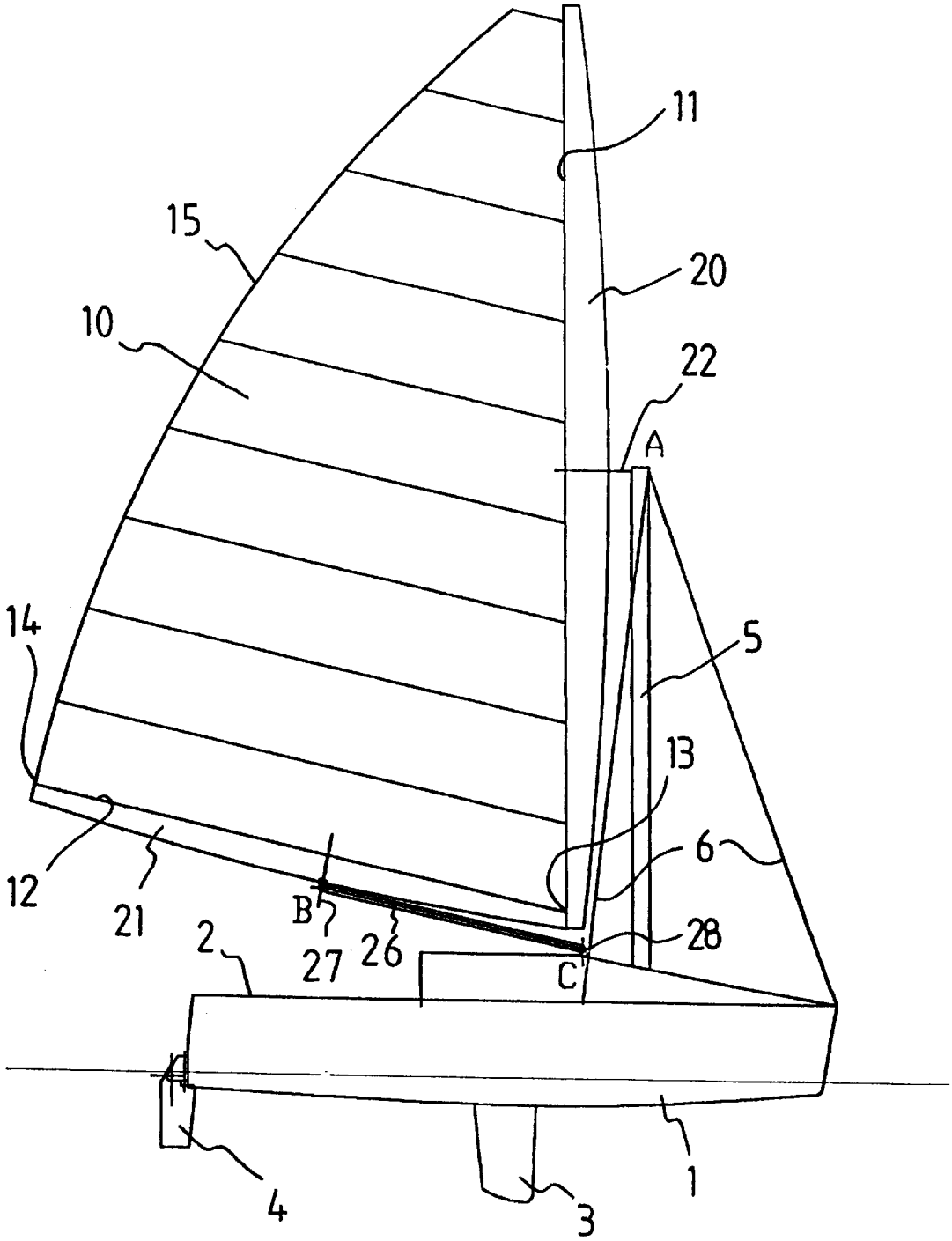
FIG. 1 is a side elevation of a single hulled sailing boat provided with a tilting sail arrangement in accordance with the invention, showing the sail in a vertical position.

Referring firstly to FIG. 1, the sailing boat comprises a hull 1 with a deck 2, a keel 3 and a rudder 4 mounted at the stern. Towards the forward end of the hull a stub mast 5 is upstanding from the deck 2. The mast may be self-supporting or held by stays 6 for example.

The boat has a sail 10 with a generally vertical luff edge 11. A generally horizontal foot edge 12 extends from a tack end 13 adjacent to the luff to a clew 14 at the stern end of the sail. A curved leach edge 15 joins the clew to the top of the luff. The luff 11 is supported by a luff boom 20, which may be of a known aerofoil shape, whereas the foot edge 12 is secured to a foot boom 21, which is connected to the luff boom 20 at the tack 13. Approximately mid-way along its length and above the centre of effort of the sail, the luff boom 20 is mounted from the top of the stub mast 5 (position A) by a pivotal fitting 22. The fitting is arranged to permit the sail to rotate about the axis of the mast as in a conventional rig, but in addition, the fitting permits tilting of the luff boom about both a fore-aft axis and about a transverse axis running from port to starboard.

A rigid swing boom 26 is pivotally connected between the foot boom 21 at position B and the deck 2 at position C. The aft end of the swing boom 26 is connected to the foot boom 21 by a universal-type pivotal connection 27 about mid-way along the foot boom. The forward end of the swing boom is similarly connected to the deck by a further universal-type pivotal connection 28. When the sail 10 is disposed on a vertical plane as shown in FIG. 1 the swing boom holds the foot boom in such a position that the luff is substantially vertical, as in a conventional sail.

It is not essential that the connection 28 be fixed relative to the deck 2. For example, the connection could be mounted on a carriage which slides along a track running transversely across the deck, from port to starboard. Also, the connection 28 could be mounted on another structural part of the craft such as the roof of a cabin or the bottom of the stub mast 5.

Figure 2:
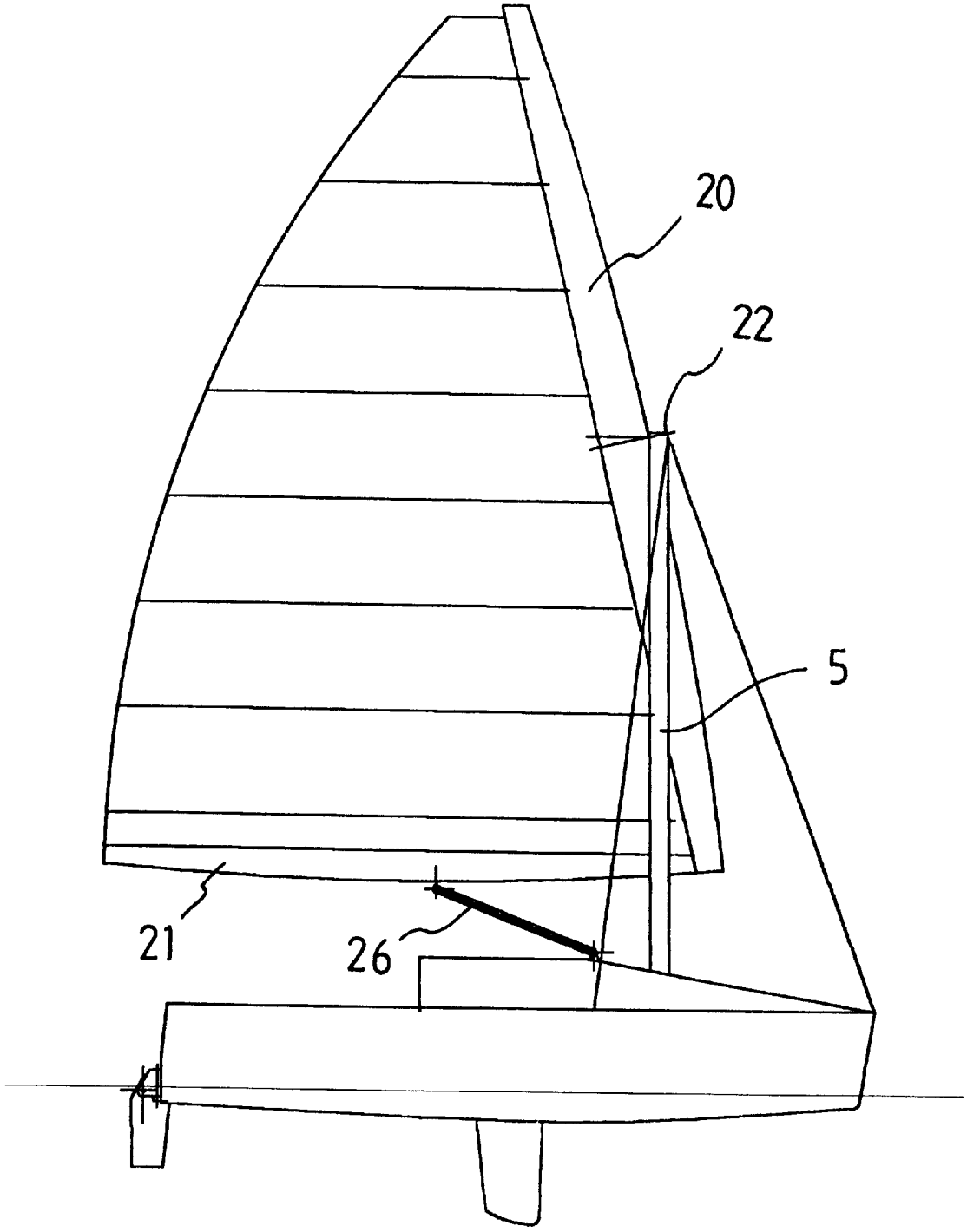
FIG. 2 is a side elevation of the sailing boat showing the sail in a partially tilted configuration.
Figure 3:
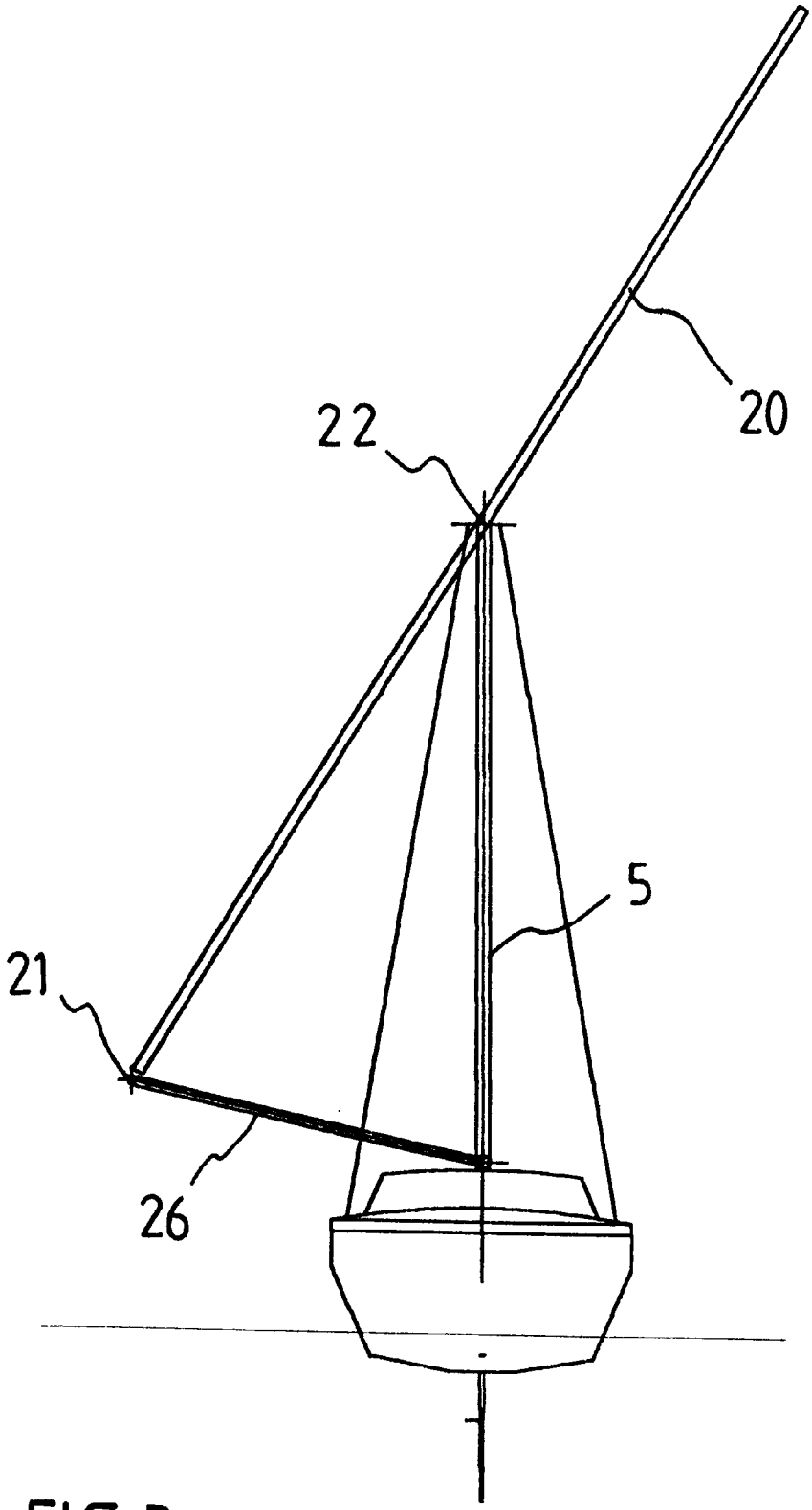
FIG. 3 is a front elevation of the sailing boat showing the sail in the tilted configuration of FIG. 2.
Figure 4:
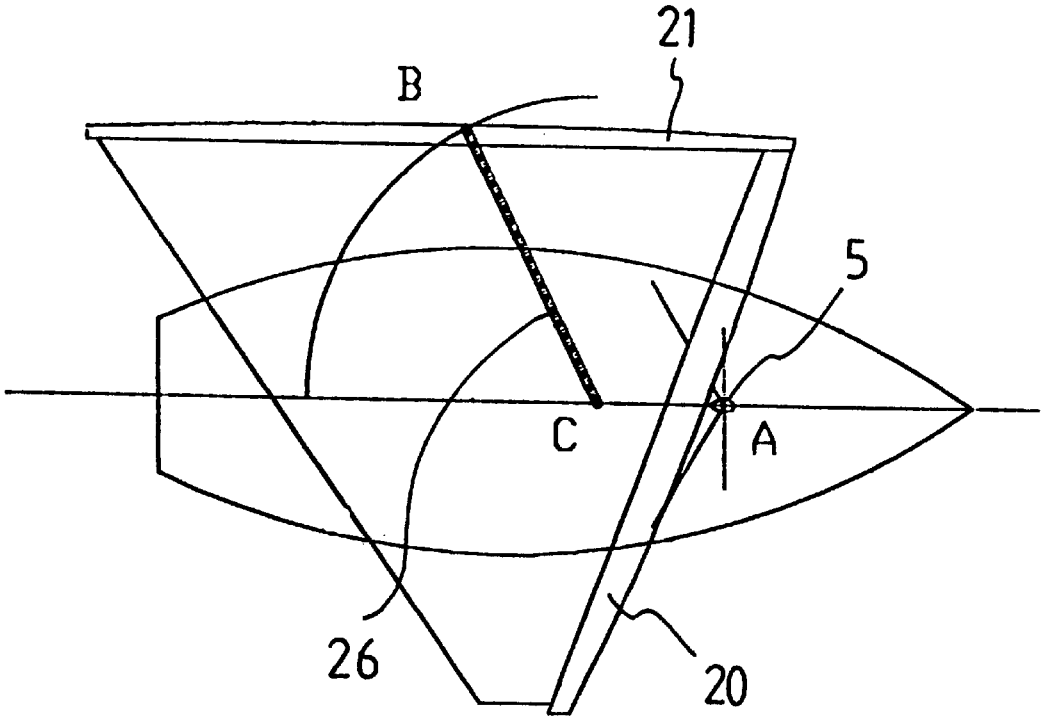
FIG. 4 is a plan view of the sailing boat showing the sail in the configuration of FIGS. 2 and 3.
Figure 5:
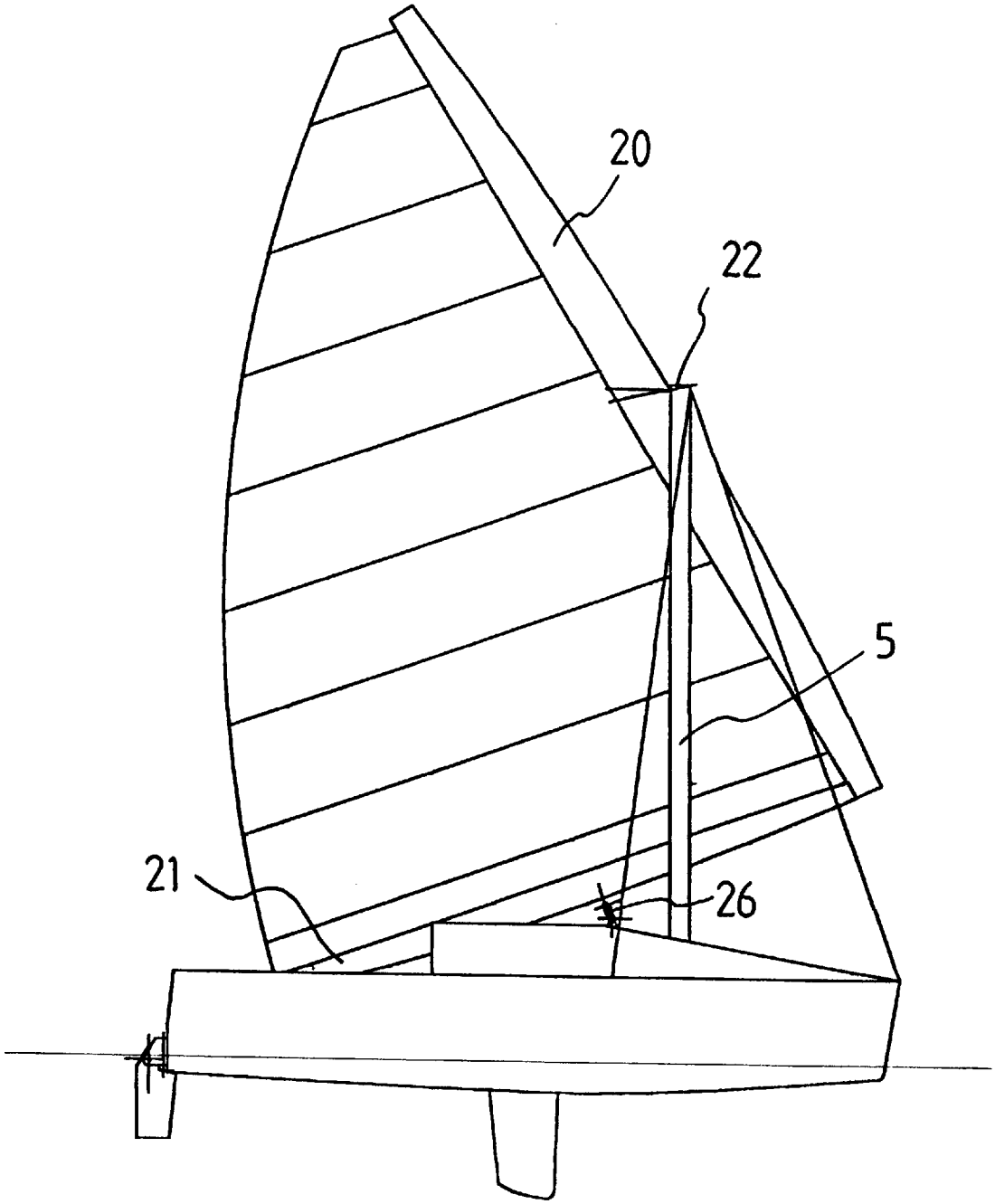
FIG. 5 is a side elevation of the sailing boat showing the sail in a fully tilted configuration.

As in a conventional rig, movement of the sail and swing boom 26 can be controlled by ropes (not shown), known in sailing as a "sheets". The sail is moved to port or starboard by rotating the whole rig about the axis between A and C. However, the sail assembly also rotates about an axis running through A and B causing the sail to tilt as illustrated in FIGS. 2 to 4 and creating a lifting force in addition to a propelling force. The Inclination of the sail to the wind can be varied to take account of the wind direction and the intended direction of travel by rotating the foot boom relative to the swing boom along axis A-B. The centre of effort and the tilt angle of the sail can also be varied by rotating the swing boom 26 fore and aft. Maximum inclination is obtained when the swing boom is substantially perpendicular to the fore-aft axis, as shown in FIG. 5. The tilt angle of the sail generates a lifting force, which counteracts the overturning moment on the craft and increases stability compared with conventional rigs. The lifting force also reduces the displacement of the craft allowing it to float higher in the water, which reduces hull drag and increases its efficiency.

Figure 6:
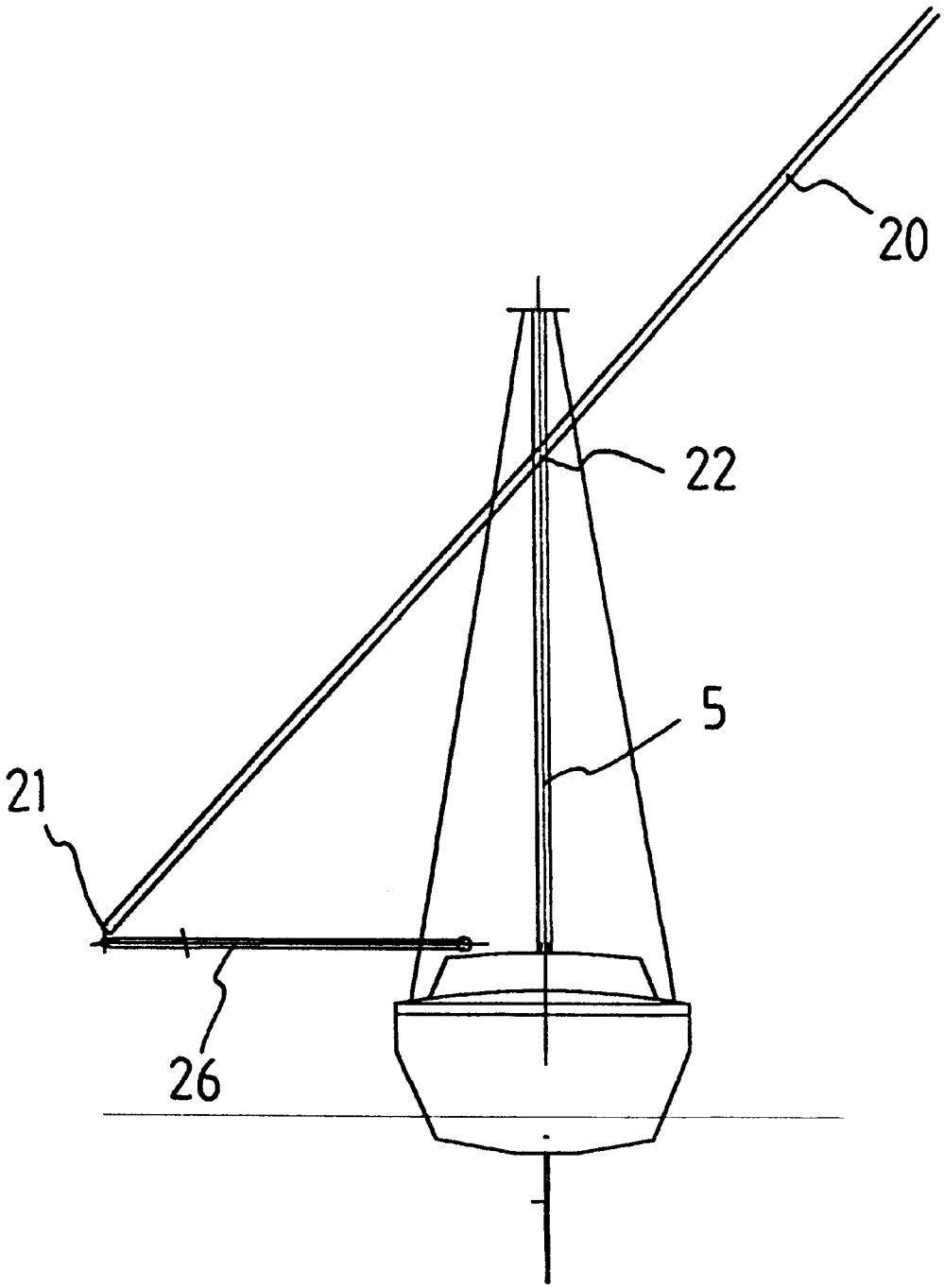
FIG. 6 is a front elevation of the sailing boat showing the sail in a similar configuration to FIG. 5 but with an increased tilt angle.

A greater range of tilt angles can be obtained by arranging the pivotal fitting 22 to be moved up and down the stub mast 5 by means of a tilt sheet. As shown in FIG. 6, lowering the fitting 22 will increase the angle of inclination still further. Also, an arrangement such as that described above in which the pivot at position C can be moved transversely to the fore-aft axis will allow the tilt angle to be increased or decreased by moving the pivot at C in the direction of or away from the sail.

The centre of effort of the force on the sail is rearward of the axis through A and B; therefore the sail will naturally tail in the direction of the wind. As the vessel passes from one tack to the other, the sail, with the help of the swing boom 26, will naturally swing astern of the stub mast and is therefore self tacking. The rigid swing boom 26 also allows the sail assembly to be positively controlled through all points of sailing and prevents any possibility of collision with the stub mast 5.

The trim of the vessel (i.e. "lee helm" or "weather helm") can easily be adjusted by moving the sail fore and aft, which moves the lateral centre of effort in relation to the centre plate or keel.

Although the above description refers to a main sail a similar arrangement of rigging can be applied to any auxiliary sail instead of or in addition to a main sail.

It will be appreciated that the features disclosed herein may be present in any feasible combination. Whilst the above description lays emphasis on those areas which, in combination, are believed to be new, protection is claimed for any inventive combination of the features disclosed herein.

What I claim is:

1. A sailing craft which includes:

a hull;

a stub mast upstanding from the hull;

a sail having a luff edge and a foot edge;

a luff boom to which the luff edge of the sail is secured;

a foot boom to which the foot edge of the sail is secured and which is connected to the lower end of the luff boom;

a pivotal fitting connecting the luff boom to the stub mast; and a rigid swing boom which is pivotally connected between the foot boom and the hull or the stub mast.

2. A sailing craft according to claim 1, in which the swing boom is connected part-way along the foot boom.

3. A sailing craft according to claim 1, in which the swing boom is connected to a carriage which is movable along a track extending transversely of the hull.

4. A sailing craft according to claim 1, in which the pivotal fitting can be moved up and down the stub mast by means of a tilt sheet.

* * * * *